United States Patent [19]

Bodin

[11] 4,339,045

[45] Jul. 13, 1982

[54] SWITCH PLATE ARTICLE HOLDER

[76] Inventor: Leo Bodin, 2770 Dennis La., Lemon Grove, Calif. 92045

[21] Appl. No.: 156,184

[22] Filed: Jun. 3, 1980

[51] Int. Cl.[3] ..... A47F 7/00

[52] U.S. Cl. ..... 211/13; 174/66; 211/69.5

[58] Field of Search ..... 211/13, 87, 69.5, 105.1; 40/19.5, 2 A; 248/115, 301, 309 R, DIG. 2; 174/66

[56] References Cited

U.S. PATENT DOCUMENTS

| | | | |
|---|---|---|---|
| 797,214 | 8/1905 | O'Haire | 211/87 |
| 1,487,085 | 3/1924 | Blackshear | 211/87 |
| 2,077,316 | 4/1937 | Geib | 211/87 |
| 2,159,322 | 5/1939 | Drummond | 211/13 |
| 2,438,143 | 3/1948 | Brown | 174/66 X |
| 2,943,138 | 6/1960 | Reager | 174/66 |
| 3,156,443 | 11/1964 | Lupinacci | 248/301 X |
| 3,331,915 | 7/1967 | Lucci | 248/309 X |
| 4,239,167 | 12/1980 | Lane | 248/DIG. 2 |

*Primary Examiner*—Roy D. Frazier
*Assistant Examiner*—Robert W. Gibson, Jr.
*Attorney, Agent, or Firm*—Brown & Martin

[57] ABSTRACT

An article holder for holding keys, glasses, and the like is adapted to be mounted on a wall switch adjacent the doorway of a room to receive and support articles such as keys, glasses, and the like in a convenient place. The holder includes a plate which is adapted to be mounted directly to the switch of a wall mounted switch either overlapping the switch plate or including a switch plate portion integral therewith.

5 Claims, 6 Drawing Figures

SWITCH PLATE ARTICLE HOLDER

BACKGROUND OF THE INVENTION

The present invention relates to article holding brackets and pertains particularly to a holder for keys, glasses and the like.

The most frequently misplaced articles in and about a home, office, or the like, are keys and glasses. Frequently upon entering a room, a person has in his hands his glasses and his keys and will place them on the nearest, most available location. Upon leaving the room or preparation for leaving the room, the person immediately recognizes the need for the glasses and the keys and immediately begins a search for them. Since each room is different and the location of a place for placement of the glasses and keys is different in each room, it frequently takes several minutes to locate the keys and or the glasses.

It would therefore be desirable that some device or means be available for quickly locating and holding keys, glasses, and the like.

SUMMARY AND OBJECTS OF THE INVENTION

It is therefore the primary object of the present invention to provide an improved article holder.

In accordance with the primary aspect of the present invention an article holder for keys, glasses, and other similar articles includes a mounting plate for mounting directly to a wall switch and includes an arm for hanging key chains and the like and a slot for receiving the temple pieces of a pair of glasses for holding the glasses.

BRIEF DESCRIPTION OF THE DRAWINGS

The above and other objects and advantages of the present invention will become apparent from the following description when read in conjunction with the drawings wherein.

DETAILED DESCRIPTION OF PREFERRED EMBODIMENTS

Figure 1:
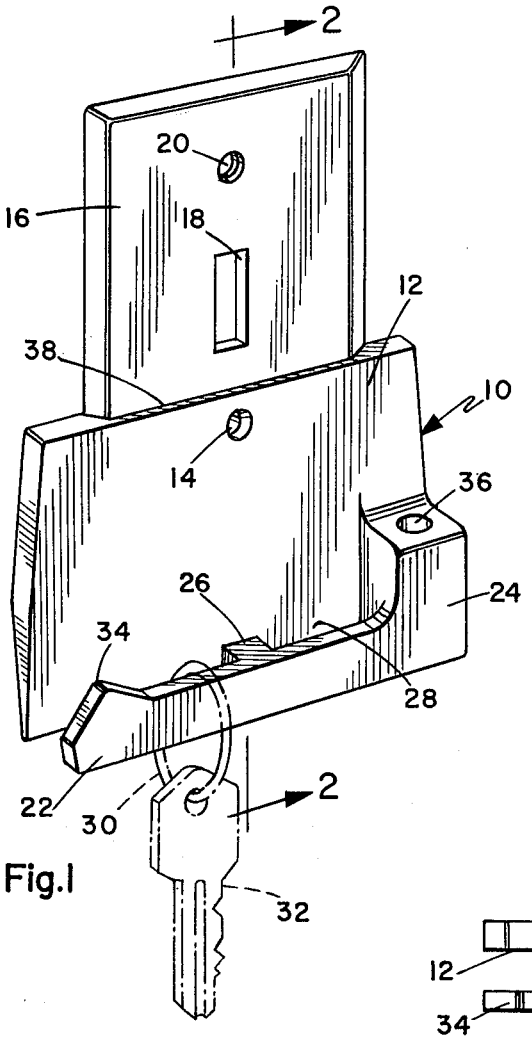
FIG. 1 is a perspective view of a switch plate and holder combination.

Turning to FIG. 1 of the drawing, there is shown an article holder in accordance with the invention designated generally by the numeral 10. This article holder includes an enlarged flat mounting plate 12 having a screw hole or aperture 14 therein for receiving switch plate mounting screw. The article holder includes the enlarged flat mounting plate 12 which is adapted to mount vertically on a wall over the lower end of a switch plate 16 and to overlap the lower screw mounting hole.

The switch plate 16 is illustrated as a substantially standard type plate for a single wall mounted electrical switch typically located adjacent the entry way of offices or the rooms of homes. The switch plate is generally rectangular in configuration having an aperture or slot 18 through which a switch lever extends and a pair of holes 20 through which the mounting screws for the switch plate extend, for threading into the underlying switch. Different styles and shapes of switch plates are known and the present invention can be adapted to fit such switch or plates. The illustrated plate is of a conventional and commonly known type.

The article holder 10 as previously described includes a flat plate 12 which overlies the lower portion of the switch plate 16. The plate includes an arm 22 extending along horizontally and parallel to the face of the face plate or mounting plate 12. The arm 22 is secured to the plate 12 at a block portion 24 and an anchor member 26. The anchor portion 26 spaced along the arm conbined and together with the base anchor portion 24 forms an upwardly open elongated slot 28 for receiving the side pieces of a pair of glasses. The side pieces of a pair of glasses can be extended through or stuck down through the slot from above and glasses will hang in place on the support holder.

The remaining portion of the arm 22 extending beyond the anchor portion 26 has a free end and permits the placing of loops such as key rings or key chains thereover for supporting on the rack. As illustrated in FIG. 1, a key ring 30 may extend over the arm 26 to hold a key 32 shown in phantom 6. The outer end of the arm 22 can include a bump or stop 34 which prevents the ring 30 from accidently slipping off the end of the arm. A bore or hole 36 is provided in the block member 24 for receiving a pencil, pen or the like. Thus the article holder can conveniently hold one or more sets of keys, one or more pairs of glasses, and the like, and a pen or pencil in a convenient position or location adjacent the doorway of an office or other room.

Figure 2:
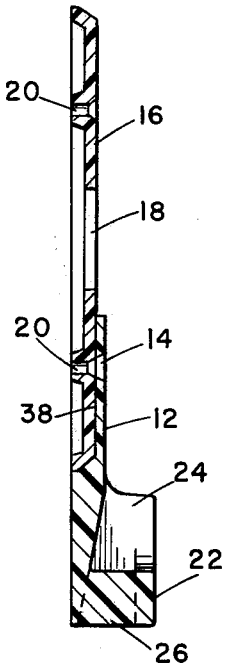
FIG. 2 is a sectional view taken in line 2—2 of FIG. 1.

The plate as seen in FIG. 2 includes a cutout or depression portion at 38 which overlies and fits around the lower end of the plate 16. Thus, the holder of FIGS. 1 and 2 can be quickly and conveniently attached or secured directly to a conventional light switch face plate.

Figure 3:
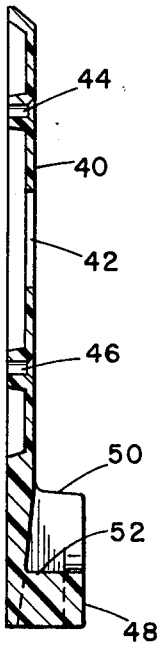
FIG. 3 is a similar sectional view showing the switch plate and holder as a unitary element.
Figure 4:
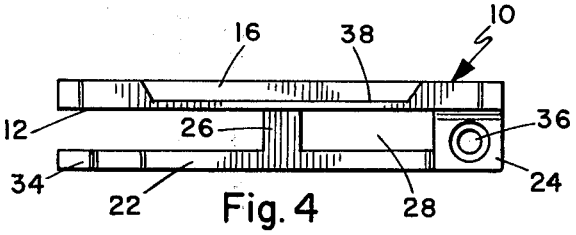
FIG. 4 is a top plan view of the structure of FIG. 1.

Turning to FIG. 3, there is illustrated an embodiment wherein the holder portion is molded integrally with the switch plate. As seen in FIG. 3, a plate 40 shaped to fit over a switch includes a slot 42 for the switch arm and a pair of screw holes 44 and 46 for receiving screws for mounting the plate directly on the wall mounted switch. The lower end of the plate is molded directly in the form of a holder as previously described wherein an arm member 48 constructed as previously described, extends across the front of the plate from a base block member 50 and includes an anchor or connecting member 52 separating the arm, making a slot and separate arm having a free end as previously described for receiving the loop of a key ring or chain.

Figure 5:
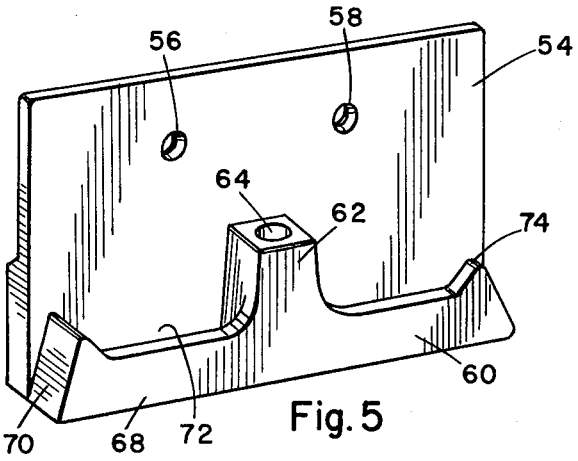
FIG. 5 is a perspective view of an alternate configuration of the holder.
Figure 6:
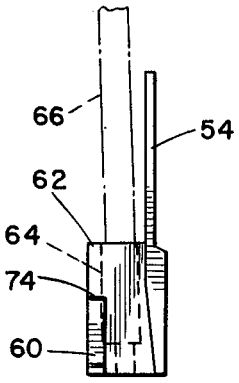
FIG. 6 is a side elevation view of the holder of FIG. 5.

Turning to FIG. 5, there is illustrated an embodiment for fitting a double switch plate. In this configuration a mounting plate 54 includes a pair of laterally spaced screw holes or bores 56 and 58 for mounting by the screws of a double switch or a pair of adjacently located switches. The holder portions also is slightly modified and includes an arm 60 which extends horizontally across the front of the mounting plate 54 and includes a centrally located block or post member 62, in which is formed a bore or hole 64 for receiving a pen or pencil. This bore is slightly tilted or angled outward from the face plate as shown in FIG. 6 to space the upper portion of the pen or pencil 66 away from the mounting plate for easier grasping of the shaft or shank of a pen or pencil. The arm structure includes a free arm and an outer portion 68 which is secured at the end by means by a block or the like at 70, forming an upwardly open laterally extending slot 72 for receiving the side temple pieces of a pair of glasses or the like. The arm 60 includes an upwardly extending bump or stop member 74 for preventing the key chain or key ring from sliding off the end of the arm. This portion can also be made into a complete unitary plate as in the FIG. 3 embodiment.

While I have illustrated and described my invention by means of specific embodiments, it is to be understood that numerous changes and modifications may be made the rein without departing from the spirit and scope of the invention as defined in the appended claims.

For example the mounting plate of the rack can be adapted to mount directly to the wall rather than on a switch or switch plate. This can be done simply by providing an adhesive strip on the plate or double adhesive stip to be placed on the back, or any other convenient mounting means such as screws on the like.

I claim:

1. An article rack for mounting on a wall switch comprising:

a mounting plate adapted to be detachably secured to a wall mounted electrical switch, an arm spaced outward from said mounting plate and extending horizontally, parallel to the plate for receiving and holding a key ring and the like, a first support block member supporting said arm on said mounting plate, a vertically open horizontally elongated slot extending across the face of said plate for receiving the side piece of a pair of glasses, a stop member extending upward from said upper surface at the outer end of said arm, a vertically oriented bore formed in said first block member for receiving and holding a pencil.

2. The article rack of claim 1 wherein said mounting plate is adapted to fit over the lower portion of the face plate of a wall switch.

3. The article holder of claim 1 wherein said mounting plate defines a face plate for a wall switch.

4. The article holder of claim 1 wherein the axis of said bore extends at a slight outward angle to said mounting plate for spacing the upper end of a pencil that is supported therein away from the mounting plate.

5. The article holder of claim 4 including a second block member extending outward from the front of said mounting plate, said slot is defined by said arm extending between said block members, and a bore formed in one of said block members for receiving a pencil.

* * * * *